United States Patent [19]

Kuramoto

[11] Patent Number: 4,869,089

[45] Date of Patent: Sep. 26, 1989

[54] COIL BOX APPARATUS

[75] Inventor: Satoru Kuramoto, Kobe, Japan

[73] Assignee: Mitsubishi Denki Kabushiki Kaisha, Tokyo, Japan

[21] Appl. No.: 177,991

[22] Filed: Apr. 5, 1988

[51] Int. Cl.[4] ..... B21C 47/06; B21C 47/18

[52] U.S. Cl. ..... 72/13; 72/128; 72/148; 72/202

[58] Field of Search ..... 72/13, 128, 146, 148, 72/200, 202, 371

[56] References Cited

U.S. PATENT DOCUMENTS

| | | | |
|---|---|---|---|
| 4,263,798 | 4/1981 | Wladika et al. | 72/202 |
| 4,442,690 | 4/1984 | Hirschmanner et al. | 72/128 |
| 4,485,651 | 12/1984 | Tippins et al. | 72/148 X |
| 4,589,268 | 5/1986 | Sakurada et al. | 72/202 X |
| 4,703,640 | 11/1987 | Buchegger et al. | 72/128 |
| 4,761,983 | 8/1988 | Ginzberg et al. | 72/148 |

FOREIGN PATENT DOCUMENTS

| | | | |
|---|---|---|---|
| 61-269905 | 11/1986 | Japan | 72/202 |
| 2123725 | 2/1984 | United Kingdom | 72/202 |

*Primary Examiner*—E. Michael Combs
*Attorney, Agent, or Firm*—Burns, Doane, Swecker & Mathis

[57] ABSTRACT

A coil box apparatus provided between a roughing roll and a finishing mill at a hot rolling mill so as to coil a rolled material transported from the roughing mill in order to make the temperature distribution of the rolled material more uniform, which is provided with a controller for computing a stand-by time of the coiled rolled material in a coil box on the basis of a condition of proceeding a rolling operation of an advanced rolled material at the finishing mill of the downstream side process, and predicting a temperature difference between the outermost first coiled layer and the inside coiled layers from the second coiled layer of the coiled rolled material after the lapse of the computed stand-by time with reference to information of the previously stored temperature drop at each part of the coiled rolled material, so that when the predicted value is larger than the reference value, the coiled rolled material is covered on the surface of the outermost first coiled layer thereof by coil covers formed of heat insulating material.

8 Claims, 3 Drawing Sheets

COIL BOX APPARATUS

BACKGROUND OF THE INVENTION

1. Field of the Invention

The present invention relates to a coil box apparatus provided between a roughing mill and a finishing mill at a hot rolling mill so as to wind up a rolled material transported from the roughing mill, and more particularly to a coil box apparatus to control a temperature of the rolled material at the finishing mill.

2. Description of the Prior Art

FIG. 1 is a schematic view of a coil box apparatus provided at the conventional hot rolling mill, in which reference numeral 1 designates a coil box enclosed by the broken line. A sheet steel rough-rolled by the roughing mill (not shown) at a hot rolling mill is transported in the direction of the arrow A, fed to the coil box 1, and coiled by a number of receiving rolls 2. The sheet steel transported from the roughing mill, which is different in temperature distribution from the utmost end to the tail 4, is coiled to make the temperature distribution more uniform. A sheet steel coil 5 coiled at the coil box 1, after the temperature of the entire coil becomes uniform, is fed toward (in the direction of the arrow B) a finishing mill 7 in the downstream side process of the hot rolling mill on the basis of a control signal from a controller 6 given a signal showing a condition of proceeding a rolling operation of an advanced sheet steel at the finishing mill. In this case, the sheet steel is uncoiled from the tail 4 thereof when transported in the direction of the arrow A from the roughing mill, and then fed to the finishing mill.

The coil box apparatus at the hot rolling mill, as above-mentioned, coils the sheet steel transported from the roughing mill to thereby make the temperature from the head to the tail of the sheet steel more uniform. When the coiled sheet steel sits for a long time in the coil box due to a delay of the rolling process for a preceding sheet steel, a temperature (a) of the outermost coiled layer of the sheet steel decreases more than that (b) of the inside coiled layers from the second coiled layer as shown in FIG. 2, thereby increasing a temperature difference between the outermost first layer and the inside layers from the second one with the result that variation occurs in a thickness and a width of the sheet steel during the finish rolling, thereby adversely affecting the product.

SUMMARY OF THE INVENTION

The present invention has been designed in order to solve the above problem.

A first object of this invention is to provide a coil box apparatus which is provided at a coil box thereof with a heat insulation means comprising a heat insulating material for thermally insulating the rolled material, thereby creating no temperature difference between the outermost first coiled layer and the inside coiled layers from the second one and improving quality of the product.

A second object of this invention is to provide a coil box apparatus which computes a stand-by time of the rolled material at the coil box on the basis of the condition of previous rolling operation for a proceeding rolled material at a finishing mill and predicts on the basis of the computed stand-by time a temperature difference between the outermost first coiled layer and the inside coiled layers from the second one of the coiled rolled material after the lapse of the stand-by time thereof, so that when the predicted value is larger than the reference value previously set, the heat insulating means covers the outermost coiled layer of the rolled material to thereby suppress a temperature drop at the outermost coil layer of the same, thus creating of course no temperature difference and improving the quality of product. Moreover, the rolled material, if necessary only, can be thermally insulated.

The above and further objects and features of the invention will more fully be apparent from the following detailed description with accompanying drawings

DESCRIPTION OF THE PREFERRED EMBODIMENTS

Next, an embodiment of a coil box apparatus of the invention will be concretely described in accordance with the accompanying drawings.

Figure 1:
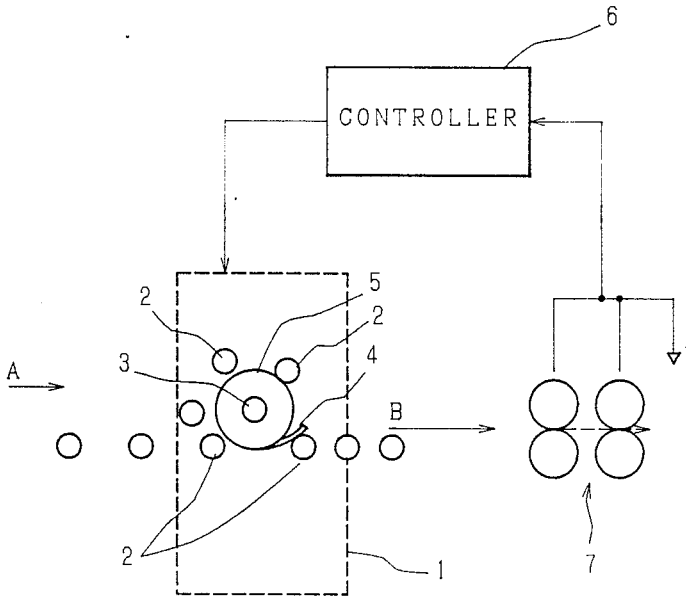
Fig. 1 Prior Art
FIG. 1 is a general structural view of the conventional coil box apparatus.
Figure 2:
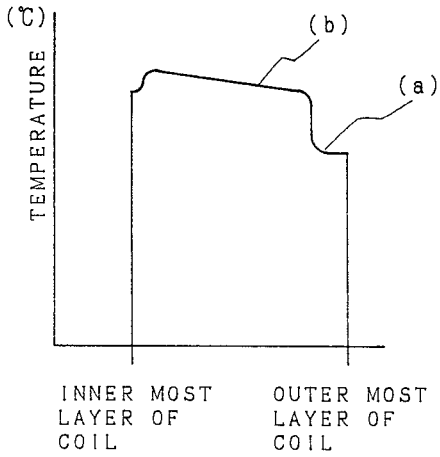
Fig. 2 Prior Art
FIG. 2 is a graph showing the temperature distribution at a coiled sheet steel stood-by in a coil box for a long time.
Figure 3:
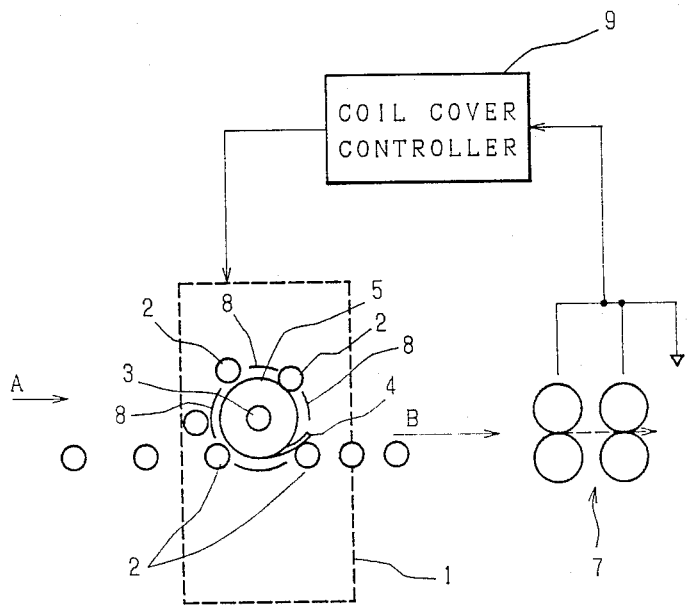
FIG. 3 is a general structural view of an embodiment of a coil box apparatus of the present invention.

Referring to FIG. 3, reference numeral 1 designates a coil box enclosed by the broken line. The coil box 1 is provided therein with a number of receiving rolls 2 for coiling a sheet steel transported from a roughing mill (not shown) and a coiler 3 serving as a core for coiling, the sheet steel from the roughing mill being adapted to be wound around the coiler 3 by means of operation of each receiving roll. Between the respective receiving rolls Z is provided a coil cover 8. The coil cover 8 is given a control signal from a coil cover controller 9 to be discussed below so as to be shifted by a driving mechanism (not shown) radially of the coiled sheet steel 5 with respect to the surface thereof.

The coil cover controller 9 is connected to a finishing mill 7 and the coil box 1, given a signal indicating the condition of proceeding the rolling operation for an advanced rolled sheet steel, computes a stand-by time for the sheet steel 5 within the coil box 1, and predicts a temperature difference at the sheet steel 5 between the outermost first coiled layer thereof and the inside coiled layers from the second one, thereby outputting a control signal for driving the coil cover 8.

Next, explanation will be given on operation of the coil box apparatus constructed as the above-mentioned. The sheet steel is coiled in the coil box 1 in a manner the same as a conventional mill. The sheet is fed from the roughing mill in the direction of the arrow A in FIG. 3 and coiled on the coiler 3 by the receiving rolls 2. An extent of the stand-by time of the coiled sheet steel in the coil box 1 relates to the condition of proceeding the rolling operation of an advanced sheet steel on the process at the downstream side (the finishing process). In a case where the rolling operation of a prior sheet steel prolongs stand-by time of sheet steel 5, the coil cover controller 9 carries out control operation as shown in the flow chart in FIG. 4.

Figure 4:
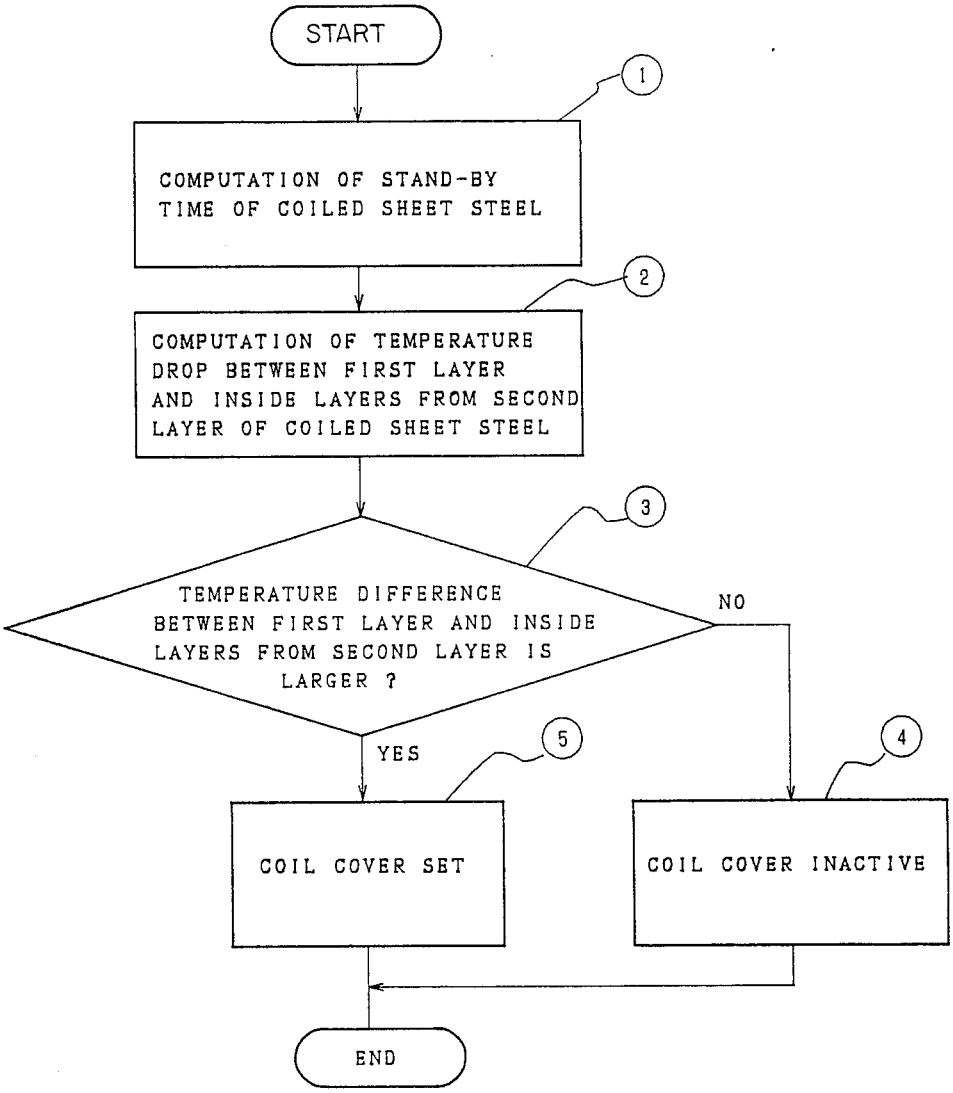
FIG. 4 is a flow chart of operation of the coil box apparatus in FIG. 3.

Next, explanation will be given on operation of the coil cover controller 9 in accordance with FIG. 4. The coil cover controller 9 computes the stand-by time of sheet steel 5 in the coil box 1 on the basis of the condition of proceeding the rolling operation of the advanced sheet steel on the finishing rolling process at the downstream side (the step①). Temperature drops at the outermost first coiled layer and the inside coiled layers from the second one of the sheet steel 5 after the lapse of the stand-by time thereof with reference to the memory data of a temperature drop curve between the previously measured temperature of the outermost coiled layer and that of the inside coiled layers from the second one at the same (the step②). Next, a temperature difference between the first coiled layer and the inside layers from the second one is decided as to whether or not it is larger than the reference value previously set (the step③).

In a case where the temperature difference is smaller than the reference value, the coil covers 8 are not actuated and the sheet steel coil 5 is kept as it is in the coil box 1 so as to stand-by for immediate transportation toward the finishing mill 7 in response of a command from the coil cover controller 9 (the step④). While, when the aforesaid temperature difference is larger than the reference value, the coil cover controller 9 outputs a control signal to actuate a driving mechanism (not shown) to shift the coil covers 8 of heat insulating material toward the sheet steel 5 (the step⑤). The sheet steel 5 is covered with the coil covers 8 to suppress the heat radiated from the outermost coiled layer, and stands-by in the coil box 1 while suppressing the temperature drop at the outermost coiled layer.

Upon deciding the end of stand-by of the sheet steel 5 in the coil box 1 on the basis of a condition of proceeding the rolling operation of the advanced sheet steel, the coil cover controller 9 outputs the control signal to allow the coil covers 8 to move away from the sheet steel 5, and the rolls 2 are rolled to begin transportation of the sheet steel 5 from the tails 4 thereof toward the finishing mill (in the direction of the arrow B in FIG. 3).

As seen from the above, even when the sheet steel 5 stands-by for a long time in the coil box 1, it is possible to effectively suppress the temperature drop at the entire sheet steel 5 and an increase in a temperature difference between the first coiled layer and the inside coiled layers from the second one at the sheet steel 5, thereby performing the next process of finish rolling with accuracy.

As this invention may be embodied in several forms without departing from the spirit of essential characteristics thereof, the present embodiment is therefore illustrative and not restrictive, since the scope of the invention is defined by the appended claims rather than by the description preceding them, and all changes that fall within the metes and bounds of the claims, or equivalents of such metes and bounds thereof are therefore intended to be embraced by the claims.

What is claimed is:

1. A coil box apparatus comprising:

means for receiving sheet metal and for forming said sheet metal into a roll;

means for calculating a stand-by time during which said sheet metal is to be kept rolled;

means for predicting a temperature difference developing between an outermost layer of said roll and the interior of said roll during said stand-by time on the basis of a predetermined relation between length of stand-by time and resultant temperature differences; and means for thermally insulating said roll when the predicted temperature difference exceeds a predetermined reference value.

2. An apparatus as claimed in claim 1 wherein said stand-by time calculating means calculates said stand-by time on the basis of a preceding rolling operation.

3. An apparatus as claimed in claim 1 wherein said means for thermally insulating said roll comprises:

a cover for thermally insulating said roll when brought in proximity thereto; and means for moving said cover into proximity with said roll when the predicted temperature difference exceeds the predetermined reference value.

4. An apparatus as claimed in claim 3 wherein said moving means moves said cover radially with respect to said roll.

5. An apparatus as claimed in claim 3 wherein said cover is formed of a heat insulating material.

6. A method of controlling a temperature difference developed in a roll of sheet metal kept in a coil box over a stand-by time, comprising the steps of:

calculating said stand-by time during which said sheet metal is to be kept rolled;

predicting a temperature difference developing between an outermost layer of said roll and the interior of said roll during the calculated stand-by time on the basis of a predetermined relation between length of stand-by time and resultant temperature differences; and thermally insulating said roll when the predicted temperature difference exceeds a predetermined reference value.

7. A method as claimed in claim 15 wherein said stand-by time calculating step includes the step of calculating said stand-by time on the basis of a preceding rolling operation.

8. A method as claimed in claim 15 wherein said step of thermally insulating said roll comprises the step of moving a cover into proximity with said roll when the predicted temperature difference exceeds said predetermined reference value.

* * * * *